US009969589B2

(12) United States Patent
Sezaki et al.

(10) Patent No.: US 9,969,589 B2
(45) Date of Patent: May 15, 2018

(54) DELIVERY PROCESSING APPARATUS AND DELIVERY PROCESSING METHOD

(71) Applicant: Kabushiki Kaisha Toshiba, Minato-ku (JP)

(72) Inventors: Kentaro Sezaki, Yokohama (JP); Takashi Aoki, Kawasaki (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days. days.

(21) Appl. No.: 14/959,335

(22) Filed: Dec. 4, 2015

(65) Prior Publication Data

US 2016/0159602 A1 Jun. 9, 2016

(30) Foreign Application Priority Data

Dec. 4, 2014 (JP) ..... 2014-245862

(51) Int. Cl.
*B65H 31/24* (2006.01)
*B07C 3/02* (2006.01)
(Continued)

(52) U.S. Cl.
CPC ..... *B65H 31/24* (2013.01); *B07C 3/02* (2013.01); *B65H 29/58* (2013.01); *B65H 43/08* (2013.01); *B65H 2301/424* (2013.01)

(58) Field of Classification Search
CPC ..... B65H 31/24; B65H 29/58; B65H 43/08; B07C 3/02
See application file for complete search history.

(56) References Cited

U.S. PATENT DOCUMENTS 5,358,238 A * 10/1994 Mandel ..... B65H 31/24 101/2
5,363,971 A * 11/1994 Weeks ..... B07C 3/06 209/584
(Continued)

FOREIGN PATENT DOCUMENTS

EP 1 655 080 A1 5/2006
EP 2 119 510 A2 11/2009
(Continued)

OTHER PUBLICATIONS

Extended European Search Report dated Aug. 23, 2016 Application No. 15197625.5.
(Continued)

*Primary Examiner* — Patrick H Mackey
(74) *Attorney, Agent, or Firm* — Oblon, McClelland, Maier & Neustadt, L.L.P.

(57) ABSTRACT

A delivery processing apparatus includes: a plurality of stackers configured to stack delivery objects; a conveyer configured to transport the delivery objects to a designated stacker out of the plurality of stackers; a first detector configured to detect that a monitored stacker out of the plurality of stackers is in an overflow state in which more than a predetermined amount of delivery objects have accumulated; a second detector configured to detect that a monitored stacker out of the plurality of stackers is in an empty state in which all delivery objects have been retrieved from the stacker; and a main controller configured to specify a regular stacker that is a stacker out of the plurality of stackers and serving as a sort destination of the delivery object.

10 Claims, 11 Drawing Sheets

(51) Int. Cl.
*B65H 29/58* (2006.01)
*B65H 43/08* (2006.01)

(56) References Cited

U.S. PATENT DOCUMENTS 5,815,764 A * 9/1998 Tomory ..... B65H 31/24 399/1
6,283,304 B1 * 9/2001 Gottlieb ..... B07C 3/00 209/603
7,251,047 B2 * 7/2007 Meade, II ..... G06Q 10/10 358/1.13
7,735,621 B2 * 6/2010 Hallowell ..... G07D 7/00 194/206
7,923,655 B2 * 4/2011 Quine ..... B07C 3/00 209/584
8,504,192 B2 * 8/2013 Faivre ..... B07C 3/00 209/583
2004/0251180 A1 * 12/2004 McDonald ..... B07C 3/00 209/584
2005/0119786 A1 * 6/2005 Kadaba ..... B07C 3/00 700/224
2006/0070929 A1 * 4/2006 Fry ..... B07C 3/00 209/583
2006/0113223 A1 6/2006 Quine et al.
2009/0283453 A1 * 11/2009 Bowers ..... B07C 3/00 209/551
2012/0296467 A1 11/2012 Bowers et al.

FOREIGN PATENT DOCUMENTS

EP 2 298 457 A1 3/2011
EP 2298457 A1 * 3/2011 ..... B07C 3/00
JP 2007-75762 A 3/2007

OTHER PUBLICATIONS

Partial European Search Report dated Apr. 28, 2016 in Patent Application No. 15197625.5.
Office Action dated Feb. 3, 2017 in Russian Patent Application No. 2015151971/12 (with English translation).

* cited by examiner

81

| PICKUP UNIT | FORMAT REJECT STACKER | BAR CODE READER | OCR PROCESSOR | VC PROCESSOR | IJP | STACKER 30(1) | . . . | STACKER 30(9) |
|---|---|---|---|---|---|---|---|---|
| CHARACTER-ISTIC INFORMATION: UNKNOWN | CHARACTER-ISTIC INFORMATION: UNKNOWN | CHARACTER-ISTIC INFORMATION: 1111 | PROCESSING FINISHED | PROCESSING FINISHED | PROCESSING FINISHED | CHARACTER-ISTIC INFORMATION: 2111 | | CHARACTER-ISTIC INFORMATION: 1111 |
| CHARACTER-ISTIC INFORMATION: UNKNOWN | CHARACTER-ISTIC INFORMATION: UNKNOWN | | CHARACTER-ISTIC INFORMATION: 1212 | CHARACTER-ISTIC INFORMATION: 2111 | CHARACTER-ISTIC INFORMATION: 1111 | CHARACTER-ISTIC INFORMATION: 1111 | | CHARACTER-ISTIC INFORMATION: 2211 |
| CHARACTER-ISTIC INFORMATION: UNKNOWN | CHARACTER-ISTIC INFORMATION: UNKNOWN | | WAIT FOR PROCESSING | CHARACTER-ISTIC INFORMATION: 1111 | WAIT FOR PROCESSING | CHARACTER-ISTIC INFORMATION: 2121 | | |
| CHARACTER-ISTIC INFORMATION: UNKNOWN | | | CHARACTER-ISTIC INFORMATION: UNKNOWN | CHARACTER-ISTIC INFORMATION: 1212 | CHARACTER-ISTIC INFORMATION: 2121 | | | |
| CHARACTER-ISTIC INFORMATION: UNKNOWN | | | CHARACTER-ISTIC INFORMATION: UNKNOWN | WAIT FOR PROCESSING | | | | |
| | | | | CHARACTER-ISTIC INFORMATION: UNKNOWN | | | | |

. . .

FIG. 5

82

| BACKUP STACKER | SORT DESTINATION |
|---|---|
| (6) | (1) |
| (7) | (1) |
| (8) | — |

FIG. 6

83

| STACKER | STATE 1 (OVERFLOW) | STATE 2 (STANDBY) |
|---|---|---|
| (1) | 1 | 0 |
| (2) | 0 | 0 |
| (3) | 0 | 1 |
| (4) | 0 | 0 |
| (5) | 0 | 0 |
| (6) | 1 | 0 |
| (7) | 1 | 0 |
| (8) | 0 | 0 |

FIG. 7

DELIVERY PROCESSING APPARATUS AND DELIVERY PROCESSING METHOD

CROSS-REFERENCE TO RELATED APPLICATION

This application is based upon and claims the benefit of priority from Japanese Patent Application No. 2014-245862, filed on Dec. 4, 2014; the entire contents of which are incorporated herein by reference.

FIELD

Embodiments described herein relate generally to a delivery processing apparatus and a delivery processing method.

BACKGROUND

Delivery processing apparatuses (postal sorters) that are used by postal services and the like perform processing in which a delivery sort destination corresponding to a region to which the address belongs is specified based on the address that is e.g. written on a delivery object, and the delivery object is transported to one out of a plurality of stackers (stackers) that corresponds to that delivery sort destination. At that time, when there are many delivery objects that are to be delivered to a specific region, it may happen that the stacker corresponding to that region becomes full, and to address this, a technique is known in which backup stackers are kept ready, and the delivery sort destination is temporarily assigned to such a backup stacker. However, in the conventional technology, there are cases in which the sorting and stacking of the delivery objects cannot be carried out efficiently.

BRIEF DESCRIPTION OF THE DRAWINGS

FIG. 5 is a diagram schematically showing the content of the data stored as delivery object state information 81;

FIG. 6 is a diagram showing an example of the information that is stored as allocation information 82;

FIG. 7 is a diagram showing an example of the information that is stored as stacker state information 83;

DETAILED DESCRIPTION

According to one embodiment, there is provided a delivery processing apparatus including a plurality of stackers configured to stack delivery objects; a conveyer configured to transport the delivery objects to a designated stacker out of the plurality of stackers; a first detector configured to detect that a monitored stacker out of the plurality of stackers is in an overflow state in which more than a predetermined amount of delivery objects have accumulated; a second detector configured to detect that a monitored stacker out of the plurality of stackers is in an empty state in which all delivery objects have been retrieved from the stacker; and a main controller configured to specify a regular stacker that is a stacker out of the plurality of stackers and serving as a sort destination of the delivery object, based on address information that is obtained from the delivery object and, control the conveyer such that the delivery object is transported to the regular stacker serving as the sort destination, out of the plurality of regular stackers, that is specified, wherein, if the stacker serving as the sort destination specified is in the overflow state, then the main controller stops the transport of delivery objects to the regular stacker serving as the sort destination that has gone into the overflow state and assigns a backup stacker that is a stacker out of the plurality of stackers not correlated with any address information as a sort destination substituting for the sort destination that has gone into the overflow state, and after assigning the substitute sort destination, when a regular stacker that had gone into the overflow state goes into the empty state, the main controller stops transport of delivery objects to the backup stacker that has been assigned as the substitute sort destination, and resumes the transport of delivery objects to the regular stacker that has gone into the empty state.

Referring to the accompanying drawings, the following is an explanation of a delivery processing apparatus and a delivery processing method according to several embodiments.

First Embodiment

Figure 1:
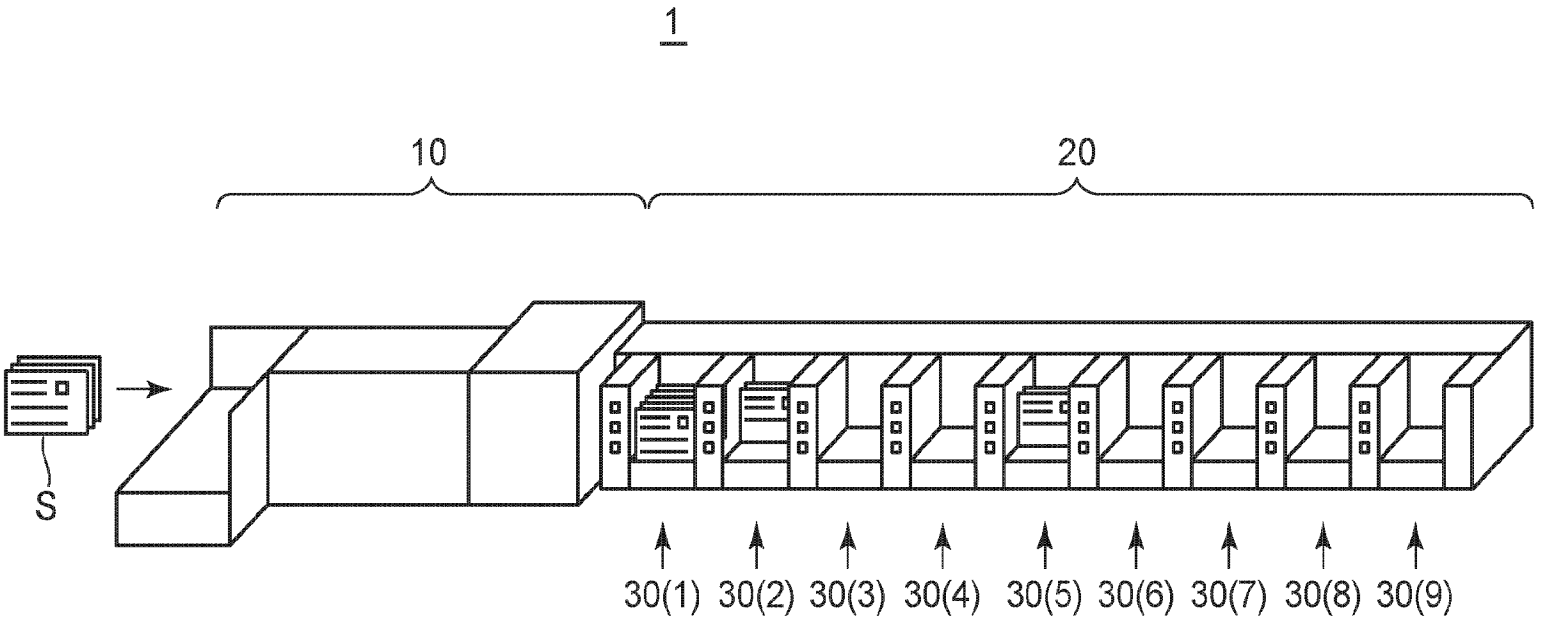
FIG. 1 is a diagram showing an overview of the configuration of a delivery processing apparatus 1 according to a first embodiment.

FIG. 1 is a diagram showing an overview of the configuration of a delivery processing apparatus 1 according to a first embodiment. This delivery processing apparatus 1 is a postal matter processing and classification device that may be set up for example in a post office or the like. The delivery processing apparatus 1 recognizes addresses that are for example written or pasted onto delivery objects S such as postcards, letters or the like, and sorts and stacks the delivery objects S in stackers according to the recognized address.

The delivery processing apparatus 1 includes a classification pre-processing unit 10 and a classification unit 20, for example. A plurality of stackers (accumulation units) 30(1) to 30(9) are disposed in the classification unit 20. In the following, numerals written in parentheses that accompany reference numerals are assumed to be stacker identification information. Note that the number of stackers 30 should be plural, that is, there should be two or more of them.

Figure 2:
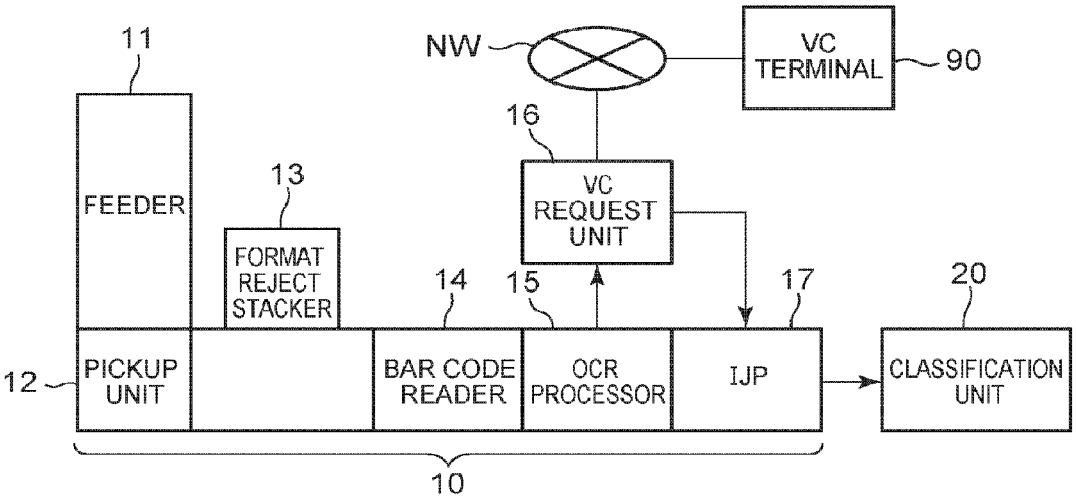
FIG. 2 is a diagram showing an overview of the configuration of the classification pre-processing unit 10.

FIG. 2 is a diagram showing an overview of the configuration of the classification pre-processing unit 10. The classification pre-processing unit 10 includes for example a feeder 11, a pickup unit 12, a reject stacker 13, a bar code reader 14, an OCR (optical character recognition) processor 15, a VC (video coding) request unit 16, and an IJP (ink jet printer) 17.

A plurality of delivery objects S are set manually e.g. by an operator in the feeder 11. The pickup unit 12 takes out, one by one, the delivery objects S that are set in the feeder 11, and supplies them to a transport path. On this transport path, delivery objects S that are contaminated by foreign matter and delivery objects S that are not of the prescribed format are eliminated and accumulated in the reject stacker 13.

The bar code reader 14 reads in bar codes from the delivery objects S on which stealth bar codes are printed, decodes the information that is encoded by the stealth bar codes and outputs the decoded information to a main controller 50 (to be described later). At this point, delivery objects S on which the stealth bar codes are printed are for example delivery objects S from which identification information could be read by VC processing (to be explained later), but which could not be transported to the stacker corresponding to their respective classification.

The OCR processor 15 includes a camera (line sensor) that takes an image of the delivery objects S, performs OCR processing on the images taken by the camera, and reads such information as a postal code, address and sender of the delivery object S. Note that a portion of the OCR processing (for example the character recognition other than that for the postal code) may also be carried out in a distributed manner by other computers that are connected via a network.

The VC request unit 16 sends images of delivery objects S for which a part or all of the information could not be read by the OCR processor 15 over the network NW to a VC terminal 90, and receives information (for example postal code or address) relating to delivery objects S from the VC terminal 90. The images received from the delivery processing apparatus 1 are displayed by the VC terminal 90 to an operator, and the information entered by the operator is returned to the delivery processing apparatus 1. This processing of displaying images and entering information is referred to as "VC processing".

The IJP 17 prints objects encoding the information about the delivery objects S that was obtained by the OCR processor 15 or the VC request unit 16 as stealth bar codes onto the delivery objects S. The stealth bar codes are then read by a bar code reader attached to the IJP 17 and verified.

Figure 3:
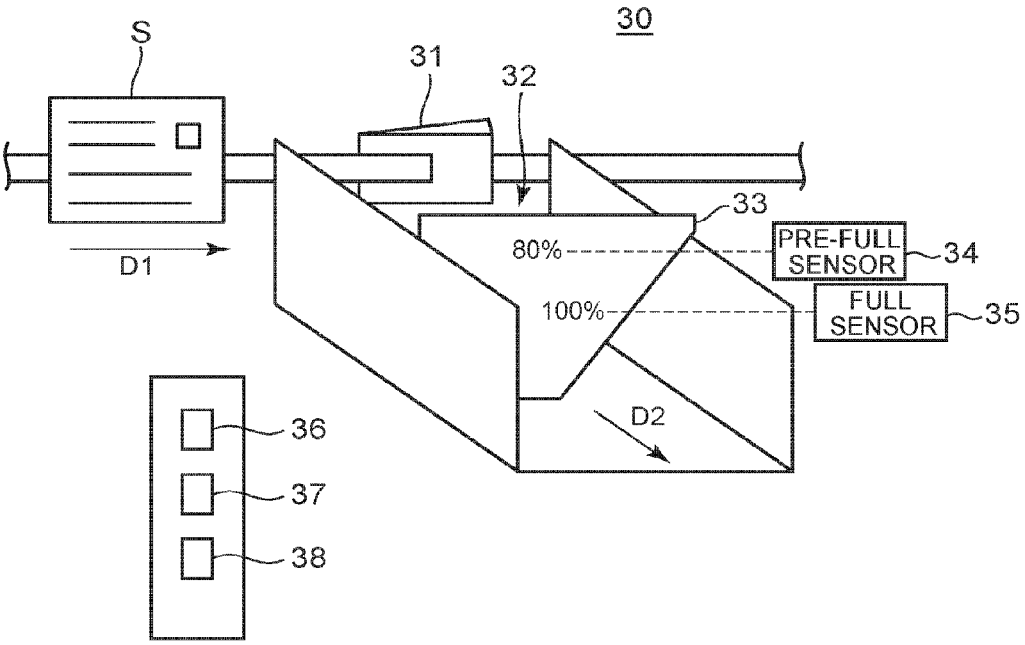
FIG. 3 is a diagram showing an example of the configuration of a stacker 30.

FIG. 3 is a diagram showing an example of the configuration of a stacker 30. Here, no differentiation is made among the stackers 30, and the following explanations are made without identifying the stacker 30 by a number in parentheses. The stacker 30 includes, for example, a diverter unit 31, an transport path 32, a backup plate unit 33, sensors 34 and 35, an full lamp 36, a stacking ready notification/sweeping and notification switch 37 and a label printing switch 38.

The diverter unit 31 directs for example delivery objects S, which are clamped by the belt and transported in the direction D1, towards the transport path 32. In the transport path 32, the delivery objects S are accumulated in an orientation parallel to the backup plate unit 33. In the drawing, the backup plate unit 33 is biased in a direction opposite to the direction D2 and thus moves in the direction D2 as the delivery objects S accumulate.

The sensors 34 and 35 output a signal in response to coming in contact with the backup plate unit 33, which is made out of metal, or the like. For example, the pre-full sensor 34 may be set up to output a signal (pre-full signal) when the stack of delivery objects S has reached about 80% of the maximum accumulation capacity of the stacker 30, and the full sensor 35 may be set up to output a signal (full signal) when the stack of delivery objects S has reached about 100% of the maximum accumulation capacity of the stacker 30.

The full lamp 36, the stacking ready notification/sweeping and notification switch 37 and the label printing switch 38 may be installed at any location (for example at an end of the lateral wall of the transport path 32). The full lamp 36 may, for example, be caused to emit yellow light when a pre-full signal is output, and may be caused to emit red light when a full signal is output. The stacking ready notification/sweeping and notification switch 37 is a switch that is to be operated when an operator has retrieved all delivery objects S from the stacker 30. For example, the stacking ready notification/sweeping and notification switch 37 may be set to ordinarily output an OFF signal and to output an ON signal when it has been operated by the operator. The label printing switch 38 is a switch for letting the apparatus issue a slip on which identification information regarding the stacker 30 is printed.

Figure 4:
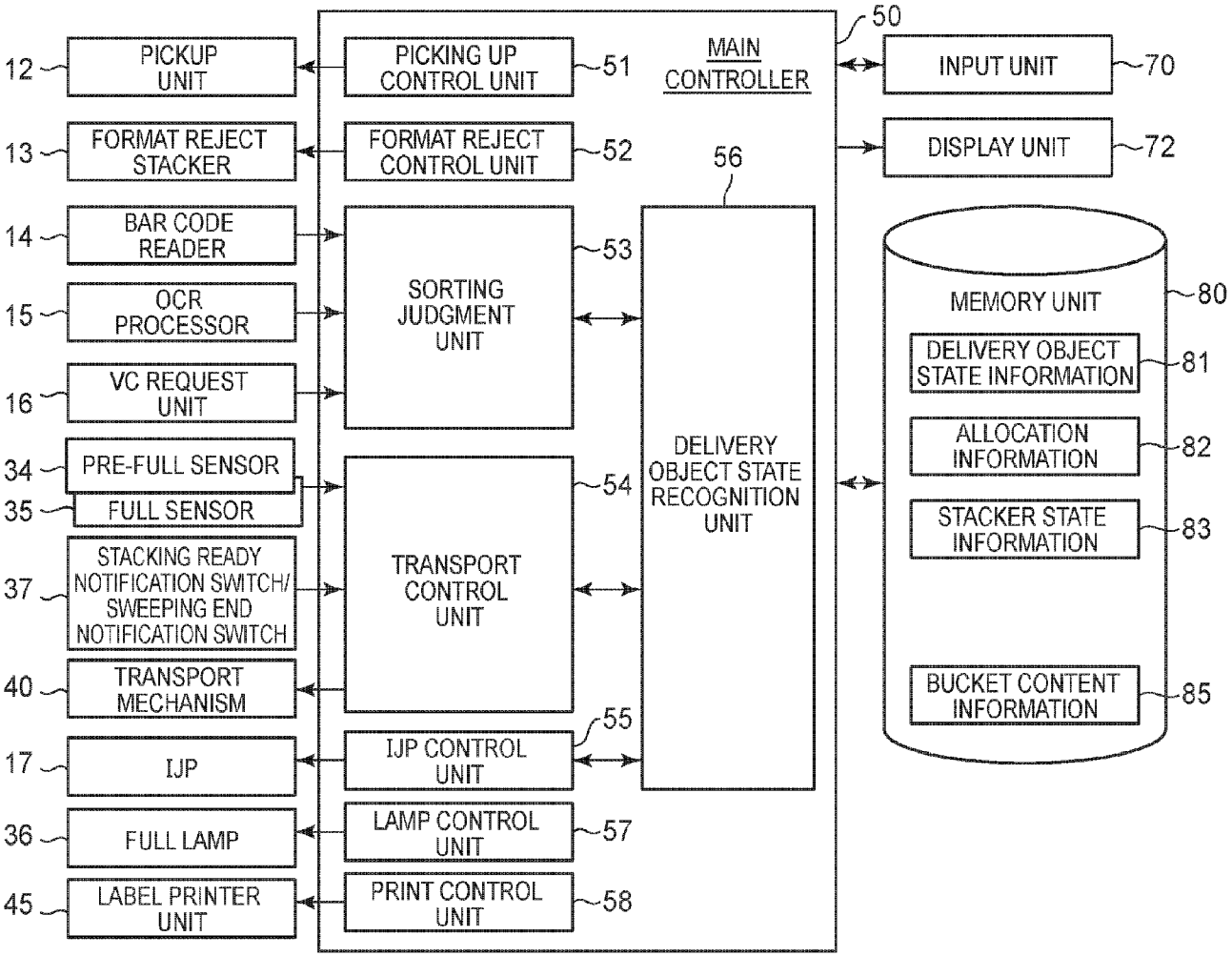
FIG. 4 is a diagram showing a configuration example of the delivery processing apparatus 1 centering on the main controller 50.

The individual units of the delivery processing apparatus 1 configured as described above are controlled by the main controller 50. FIG. 4 is a diagram showing a configuration example of the delivery processing apparatus 1 centering on the main controller 50. The main controller 50 includes, for example, a picking up control unit 51, an format reject control unit 52, a sorting judgment unit 53 (sort destination specifying unit), a transport control unit 54, an IJP control unit 55, a delivery object state recognition unit 56, a lamp control unit 57, and a print control unit 58. These functional units may also be software functional units that are implemented by letting a processor, such as a CPU (central processing unit), execute a program that is stored in a memory unit 80. Moreover, a part or all of these functional units may also be implemented by hardware, such as an LSI (large scale integration) circuit, an ASIC (application specific integrated circuit), or various types of interfaces.

Moreover, the main controller 50 is connected to a transport mechanism 40, a label printer unit 45, an input unit 70, a display unit 72, and a memory unit 80, for example. The transport mechanism 40 includes a motor that drives the diverter unit 31 in the above-described stacker 30, the belt that transports the delivery objects S in the classification unit 20, a motor driving the belt, and the like. The label printer unit 45 is a printer that is separate from the IJP 17. The input unit 70 is an input device such as a keyboard, a mouse or a touch panel. The display unit 72 is a display device such as an LCD (liquid crystal display), an organic EL (electroluminescence) display device or the like. The memory unit 80 can be realized, for example, by a RAM (random access memory), a ROM (read-only memory), a HDD (hard-disk drive), a flash memory or the like. In addition to programs that are executed by the processor of the main controller 50, the memory unit 80 stores delivery object state information 81, allocation information 82, stacker state information 83, bucket content information 85 and the like.

The picking up control unit 51 controls the pickup unit 12. The format reject control unit 52 controls for example the motor that drives the diverter unit (not shown) that directs the delivery objects toward the reject stacker 13.

The sorting judgment unit 53 obtains the processing results from the bar code reader 14, the OCR processor 15, and the VC request unit 16, and specifies, based on the address information (for example the postal address included in the processing result), the stackers 30 to which the delivery objects S are to be sorted (sort destinations). In the case of addresses in Japan, for example, the sort destinations are determined by aggregating addresses in which the "block number" (in Japanese: "-chome") in the address match. The sorting judgment unit 53 refers to correlation information that correlates the address information to the sort destination, and specifies the sort destination. It should be noted that this correlation information may be in the form of tabulated data, or information that is embedded in variables and programs.

Based on the signals that are input from the sensors 34, 35 and the signal that is input from the stacking ready notification/sweeping and notification switch 37, the transport control unit 54 lets the transport mechanism 40 transport the delivery objects S to the stacker 30 corresponding to their respective sort destination. This will be explained later. The IJP control unit 55 controls the IJP 17.

The delivery object state recognition unit 56 consolidates the processing results of the sorting judgment unit 53, the transport control unit 54, the IJP control unit 55 and the like, and recognizes the state of the delivery objects S taken out by the pickup unit 12. The delivery object state recognition unit 56 stores the recognition results as delivery object state information 81 in the memory unit 80. FIG. 5 is a diagram schematically showing the content of the data stored as delivery object state information 81. As shown in the drawing, the delivery object state information 81 contains not only characteristic information of the delivery objects S accumulated in each stacker 30, but also the number of delivery objects S and their characteristic information (that has already been ascertained) placed in the various units of the delivery processing apparatus 1. In the following, the characteristic information of the delivery objects S is assumed to be information constituted by address information of the delivery objects S, such as the postal code.

The lamp control unit 57 controls the full lamp 36 based on the signals that are input from the sensors 34 and 35. And the print control unit 58 controls the label printer unit 45 such that a list of the content of a bucket is printed in response to a request for list production by an operator. Also, when the operator has operated a label printing switch 38, the print control unit 58 lets the label printer unit 45 print identification information of the stacker 30 corresponding to that label printing switch 38.

The following is an explanation of the dynamic allocation control executed by the transport control unit 54. As shown in FIG. 1, the delivery processing apparatus 1 is provided with a plurality of stackers 30. Of these stackers 30, for example the stackers 30(1) to 30(5) are treated as regular stackers to which characteristic (unique) sort destinations are allocated, the stackers 30(6) to 30(8) are treated as backup stackers for dynamic allocation, and the stacker 30(9) is treated as a reject stacker in which delivery objects S are accumulated whose sort destination is unclear. When a regular stacker has gone into an overflow state in which more than a predetermined amount of delivery objects are accumulated, then a backup stacker is temporarily assigned as sort destinations substituting that regular stacker. Here, "overflow state" refers to a state in which that stacker 30 is full or close to being full. For example, when a pre-full signal is output from the pre-full sensor 34 or a full signal is output from the full sensor 35, then the transport control unit 54 senses that the stacker 30 is in an overflow state. Here, the regular stackers and the backup stackers may be assigned a fixed role, but their role may also change dynamically in response to the transport state of the transport control unit 54 in response to an operation of an operator. For example, it is possible to monitor the operation state of the stackers 30 over a predetermined period of time, and the transport control unit 54 may perform a control such that, when the operating ratio of the backup stackers is low, the number of backup stackers is reduced, or when the operating ratio of the backup stackers is high, the number of backup stackers is increased. In this case, it is possible to transition from a first state in which the stackers 30(1) to 30(5) are treated as regular stackers and the stackers 30(6) to 30(8) are treated as backup stackers to a second state in which the stackers 30(1) to 30(4) are treated as regular stackers and the stackers 30(5) to 30(8) are treated as backup stackers, for example. Thus, the delivery processing apparatus 1 can be operated more efficiently.

The transport control unit 54 uses the allocation information 82 to manage which backup stacker is temporarily assigned as a substitute sort destination as described above. FIG. 6 is a diagram showing an example of the information that is stored as allocation information 82. In the example of FIG. 6, the stacker 30(1) is in an overflow state, and also the stacker 30(6), which has been temporarily assigned as a sort destination substituting the stacker 30(1) has gone into the overflow state, so that, in turn, the stacker 30(7) is temporarily assigned as a sort destination substituting the stacker 30(1). Furthermore, the transport control unit 54 manages the stackers 30 that are in the overflow state using the stacker state information 83. FIG. 7 is a diagram showing an example of the information that is stored as stacker state information 83. In this drawing, state 1 denotes information indicating whether there is an overflow state, where the value "1" indicates that there is an overflow state and the value "0" indicates that there is no overflow state. Moreover, the value "1" for state 2 indicates a standby state in which the stacking ready notification/sweeping and notification switch 37 has been operated and there was a transition from the overflow state to the empty state, awaiting for the backup stacker to go into the overflow state, whereas the value "0" indicates a non-standby state.

Figure 8:
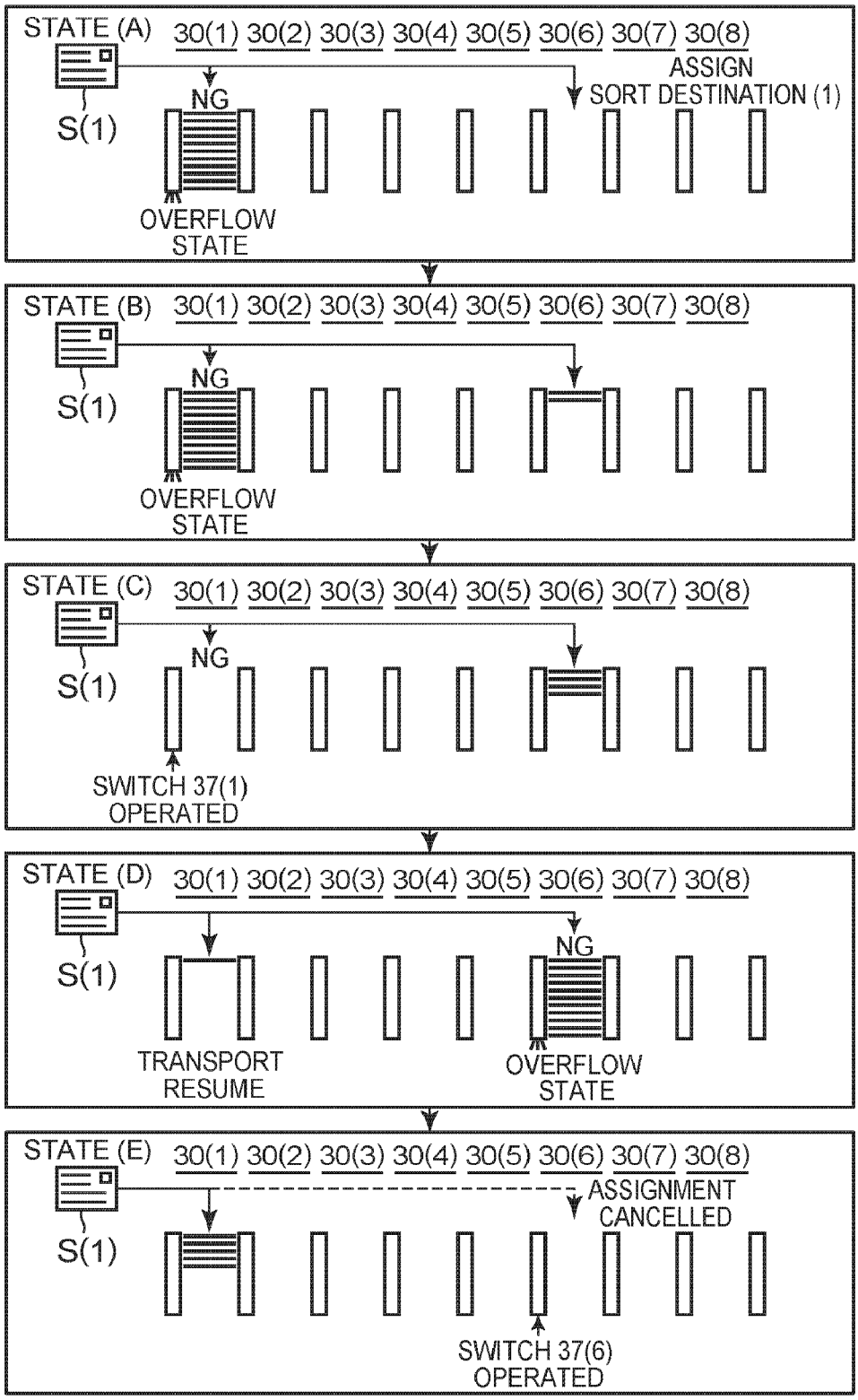
FIG. 8 is a diagram that schematically shows the control carried out by the transport control unit 54.

FIG. 8 is a diagram that schematically shows the control carried out by the transport control unit 54. In the following explanations, when the sort destination for a given delivery object S that is specified by the sorting judgment unit 53 is the stacker 30(1), then the delivery object S is denoted as delivery object S(1).

As shown in Situation (A) in FIG. 8, when the stacker 30(1), which is a regular stacker, goes into the overflow state, then the transport control unit 54 stops the transport of delivery objects S(1) to that stacker 30(1), the allocation information 82 is looked up, and the stacker 30(6), which is a backup stacker that is not yet assigned as a sort destination, is temporarily assigned as a sort destination substituting the stacker 30(1).

Then, as shown in Situation (B) in FIG. 8, until the delivery objects S(1) are retrieved from the stacker 30(1) and the stacking ready notification/sweeping and notification switch 37 (stacking ready notification/sweeping and notification switch 37(1)) of the stacker 30(1) is operated, the transport control unit 54 transports the delivery objects S(1) that actually should have been transported to the stacker 30(1) to the stacker 30(6) and not to the stacker 30(1).

Next, as shown in Situation (C) in FIG. 8, when the delivery objects S are retrieved from the stacker 30(1) and the stacking ready notification/sweeping and notification switch 37(1) is operated, the transport control unit 54 continues to transport the delivery objects S(1) to the stacker 30(6) until the stacker 30(6) goes into the overflow state. Then, as shown in Situation (D) in FIG. 8, when the stacker 30(6) has gone into the overflow state, the transport control unit 54 stops the transport of the delivery objects S(1) to the stacker 30(6) and resumes the transport of the delivery objects S(1) to the stacker 30(1) in the empty state. It should be noted that if the stacker 30(6) goes into the overflow state as well before the stacking ready notification/sweeping and notification switch 37(1) is operated, then the transport control unit 54 assigns yet another stacker as the sort destination substituting the stacker 30(1). The delivery processing apparatus 1 may also be configured such that when the stacking ready notification/sweeping and notification switch 37(1) is operated, the transport control unit 54 resumes the transport of the delivery objects S(1) to the stacker 30(1).

Then, as shown in Situation (E) in FIG. 8, when the stacker 30(6) goes into the empty state, the transport control unit 54 cancels the temporary assignment of the stacker 30(6), and when thereafter any of the regular stackers goes into the overflow state, then the stacker 30(6) may again be temporarily assigned as a sort destination to substitute for that stacker.

With this control, the delivery processing apparatus 1 of the present embodiment can perform the sorting and stacking of delivery objects S more efficiently. First of all, with the delivery processing apparatus 1 of the present embodiment, it is possible to avoid wasteful control in which, after a regular stacker that had gone into an overflow state has gone into the empty state, the transport of delivery objects to the backup stacker assigned as the substitute sort destination is stopped and the transport of the delivery objects to the regular stacker that has returned to the empty state is resumed, leading to frequent changes of the stacker 30 to which the delivery objects are transported.

Moreover, with the delivery processing apparatus 1 of the present embodiment, it is possible to prevent incomplete states in which, after a regular stacker that was in the overflow state has gone into the empty state, when the backup stacker assigned as a substitute sort destination has not yet gone into the overflow state, the transport of delivery objects to the empty regular stacker is resumed, so that the transport destination is changed to the regular stacker in a state in which there is still room on the backup stacker.

Moreover, with the delivery processing apparatus 1 of the present embodiment, if the backup stacker assigned as a substitute sort destination has gone into the empty state, the assignment to that backup stacker is cancelled, and thereafter, that backup stacker may be assigned as a substitute sort destination for a regular stacker, so that the backup stackers can be used more flexibly and it is possible to sort and stack delivery objects S more efficiently.

Figure 9:
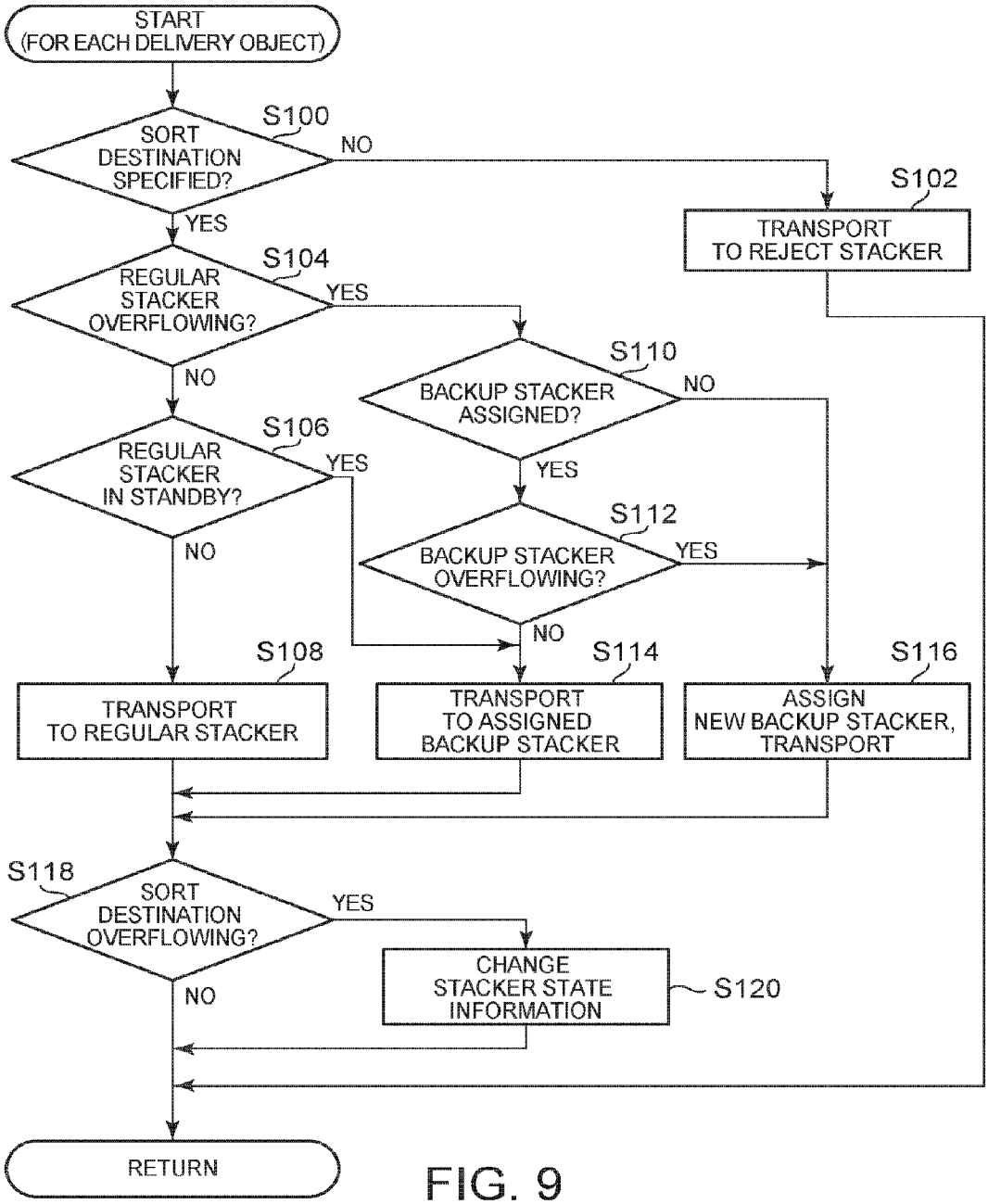
FIG. 9 is a flowchart showing the processing flow that is carried out by the transport control unit 54.

The following is an explanation of the processing that is carried out by the transport control unit 54 in order to realize the control shown in FIG. 8. FIG. 9 is a flowchart showing the processing flow that is carried out by the transport control unit 54. The processing of this flow chart is carried out for each delivery object S that is to be transported. First of all, the transport control unit 54 determines whether a stacker 30 serving as the sort destination is specified by the sorting judgment unit 53 (Step S100). If no stacker 30 is specified by the sorting judgment unit 53 as the sort destination, then the transport control unit 54 transports the delivery object S to the reject stacker (Step S102).

If a stacker 30 is specified by the sorting judgment unit 53 as the sort destination, then the transport control unit 54 looks up the stacker state information 83 and determines whether the regular stacker serving as the sort destination is in the overflow state (Step S104). If the regular stacker serving as the sort destination is not in the overflow state, then the transport control unit 54 determines whether the regular stacker serving as the sort destination is in the standby state (Step S106). If the regular stacker serving as the sort destination is not in the standby state, then the transport control unit 54 lets the transport mechanism 40 transport the delivery object S to the regular stacker serving as the sort destination (Step S108). On the other hand, if the regular stacker serving as the sort destination is in the standby state, then the transport control unit 54 lets the transport mechanism 40 transport the delivery object S to the backup stacker that is already assigned as the substitute sort destination (Step S114).

If it is determined in Step S104 that the regular stacker serving as the sort destination is in the overflow state, then the transport control unit 54 looks up the allocation information and determines if a backup stacker has been assigned to substitute as the sort destination (Step S110). If a backup stacker has already been assigned, then it is determined whether that backup stacker is in the overflow state (Step S112). If that backup stacker is not in the overflow state, then the transport control unit 54 lets the transport mechanism 40 transport the delivery object S to the backup stacker that is already assigned (Step S114).

If it is determined in Step S110 that there is no backup stacker that is assigned to substitute as that sort destination or if it is determined in Step S112 that that backup stacker is in the overflow state, then the transport control unit 54 assigns a new backup stacker as the substitute for that sort destination and lets the transport mechanism 40 transport the delivery object S to that backup stacker (Step S116).

Next, the transport control unit 54 determines whether the stackers 30 to which the delivery object S is transported is in an overflow state (Step S118). If the stacker 30 to which the delivery object S is transported is in an overflow state, then the transport control unit 54 updates the stacker state information (Step S120). With this, the processing for one delivery object S finishes.

Figure 10:
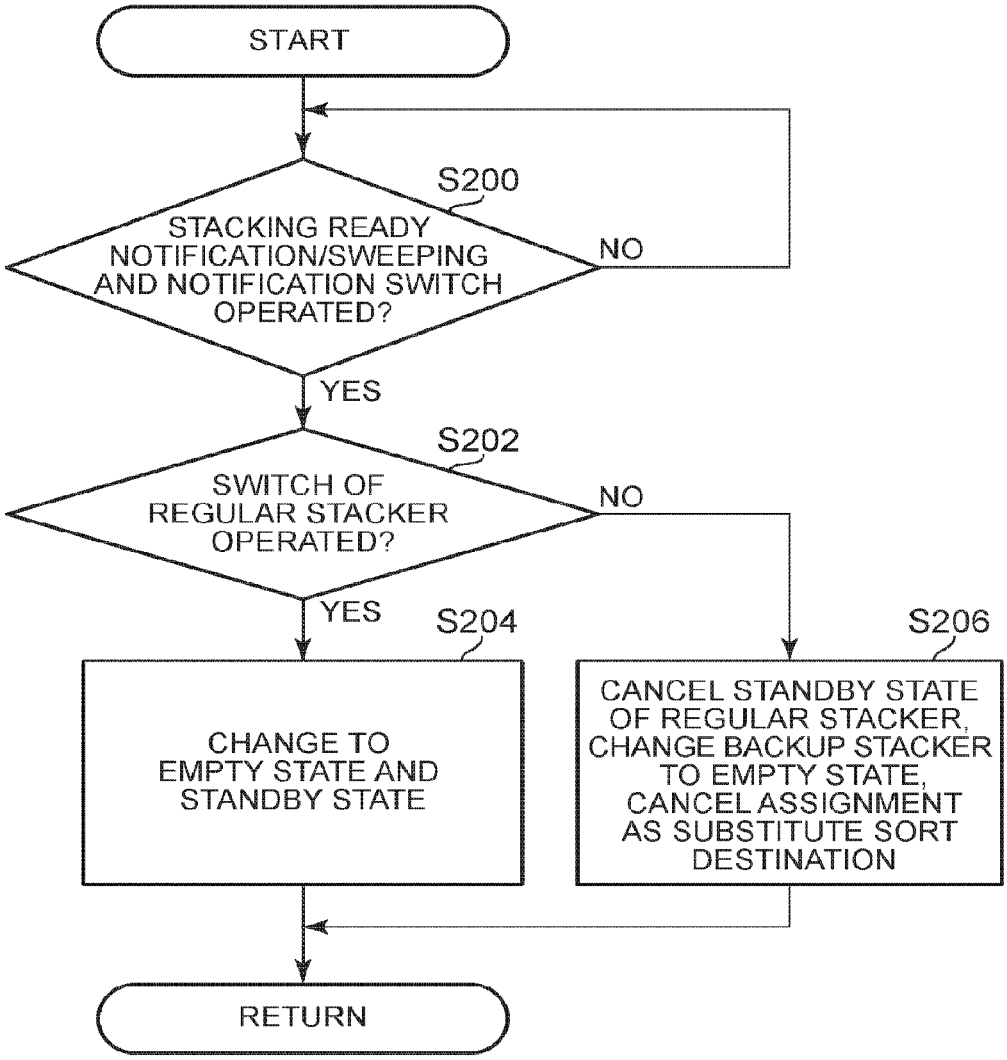
FIG. 10 is a flowchart showing the processing flow that is carried out by the transport control unit 54 in response to the operation of the stacking ready notification/sweeping and notification switch 37.

In the present embodiment, the processing when the stacking ready notification/sweeping and notification switch 37 is operated may be carried out separately and in parallel to the flowchart in FIG. 9. FIG. 10 is a flowchart showing the processing flow that is carried out by the transport control unit 54 in response to the operation of the stacking ready notification/sweeping and notification switch 37.

First of all, the transport control unit 54 waits until the stacking ready notification/sweeping and notification switch 37 is operated (Step S200). When the stacking ready notification/sweeping and notification switch 37 is operated, the transport control unit 54 determines whether the stacking ready notification/sweeping and notification switch 37 of a regular stacker has been operated (Step S202). If the stacking ready notification/sweeping and notification switch 37 of a regular stacker has been operated, then the transport control unit 54 changes the state 1 of that regular stacker in the stacker state information 83 to the empty state (0) and changes the state 2 to the standby state (1) (Step S204).

On the other hand, if the stacking ready notification/sweeping and notification switch 37 of a backup stacker has been operated, then the transport control unit 54 changes, in the stacker state information 83, the state 2 of the regular stacker to which it is assigned in substitution, to the non-standby state (0), cancelling the standby state, changes the state 1 of that backup stacker to the empty state (0) and furthermore cancels, in the allocation information 82, the assignment as a substitution for a sort destination by clearing the assigned sort destination of that standby stacker (Step S206).

Figure 11:
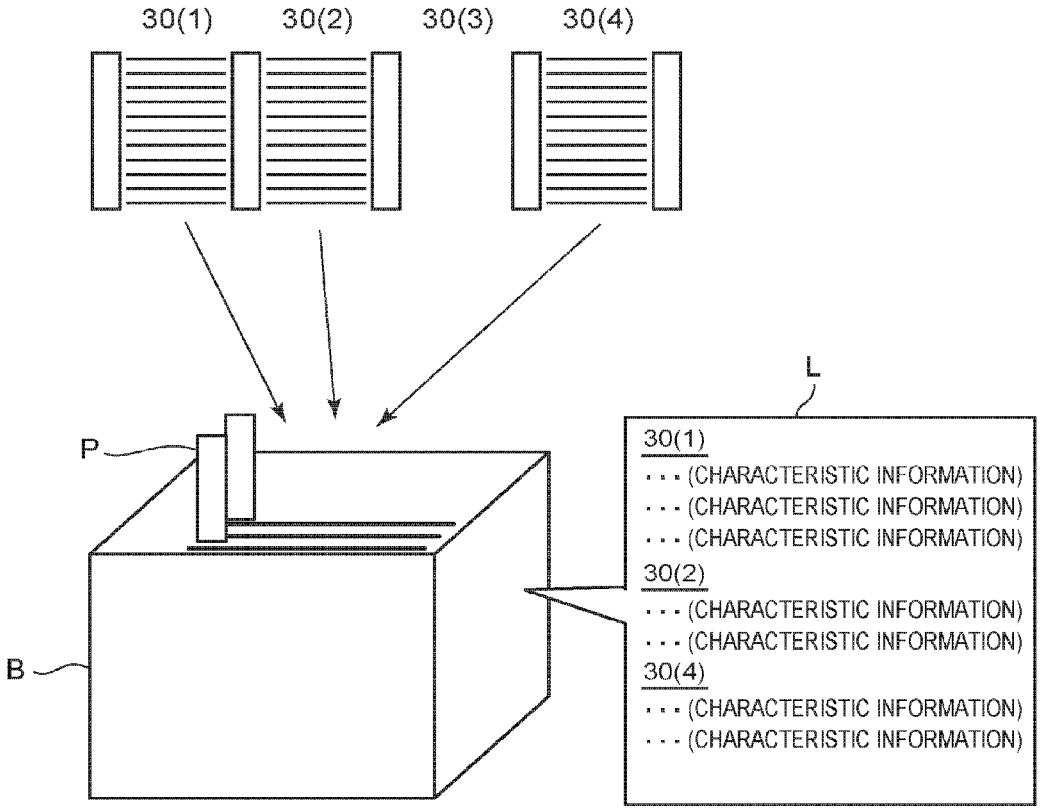
FIG. 11 is a diagram illustrating the content of the bucket content information 85.

The delivery object state recognition unit 56 generates the bucket content information 85. This is explained in the following. A bucket is a storage container in which the delivery objects S retrieved from the stackers 30 are collected. FIG. 11 is a diagram illustrating the content of the bucket content information 85. When stackers 30 go into the overflow state, then the delivery objects S that have been collected by the stackers 30 are transferred by an operator to a bucket B. Then, the operator operates the stacking ready notification/sweeping and notification switch 37 of the stacker 30 from which the delivery objects S were retrieved and operates the label printing switch 38, issuing a slip P with information indicating the stacker 30 from which the delivery objects S were retrieved. In this situation, the print control unit 58 instructs the label printer unit 45 to print the slip P. The slip P may be inserted by the operator between the delivery objects S within the bucket B, for example.

When a certain amount of delivery objects S has been collected in the bucket B, the operator operates the input portion 70 to request the delivery processing apparatus 1 to print the bucket content information 85. In preparation of this, every time the stacking ready notification/sweeping and notification switch 37 is operated, the delivery object state recognition unit 56 obtains the characteristic (individual) information of the delivery objects S collected in the corresponding stacker 30 from the delivery object state information 81 and adds it to the bucket content information 85. Then, when there is a request to print the bucket content information 85, the print control unit 58 instructs the label printer unit 45 to print a list L based on the bucket content information 85. Thus, a list L with characteristic information of the delivery objects S collected in the bucket B is printed. As shown in the drawing, the bucket content information 85 serving as a basis for the list L is information that lists characteristic information of the delivery objects S for each stacker 30 from which delivery objects S are collected. It should be noted that the label printer unit for printing the slips P and the label printer unit for printing the list L were stated to be the same, but these label printer units may also be realized by separate hardware. In this case (and also if the same label printer unit prints the slips P and the list L), the print control unit that controls the printing of the slips P and the print control unit that controls the printing of the list L may be separate functional units, that is, separate software functional units realized by separate program modules, or may include separate hardware.

As noted above, when the operator who operates the delivery processing apparatus 1 according to the present embodiment retrieves the delivery objects S from a stacker 30, he retrieves all of the delivery objects S collected in that stacker 30 and then operates the stacking ready notification/sweeping and notification switch 37. Thus, since the bucket content information 85 is updated when this is triggered by the operation of the stacking ready notification/sweeping and notification switch 37 that indicates that all of the delivery objects S collected in the stacker 30 have been retrieved, the delivery processing apparatus 1 can grasp more accurately which delivery objects S have been collected in which order in the bucket B. If it were allowed to collect in the bucket B only a portion of the delivery objects S collected in a stacker 30, then it would be difficult to grasp accurately from how many stackers 30 the delivery objects S have been collected in the bucket B.

With the delivery processing apparatus 1 according to the first embodiment as explained above, if a regular stacker serving as a sort destination specified by the sorting judgment unit 53 goes into the overflow state, then the transport of delivery objects S to this regular stacker is stopped and a backup stacker out of the plurality of stackers 30 that is not correlated with any address information is assigned as a substitute sort destination for the sort destination in the overflow state. And after assigning it as a substitute sort destination, when the regular stacker that went into the overflow state goes into the empty state, the transport of the delivery objects S to the backup stacker that is assigned as the substitute sort destination is stopped, and the transport of the delivery objects S to the empty regular stacker is resumed, so that the sorting and stacking of the delivery objects can be carried out more efficiently.

Second Embodiment

Figure 12:
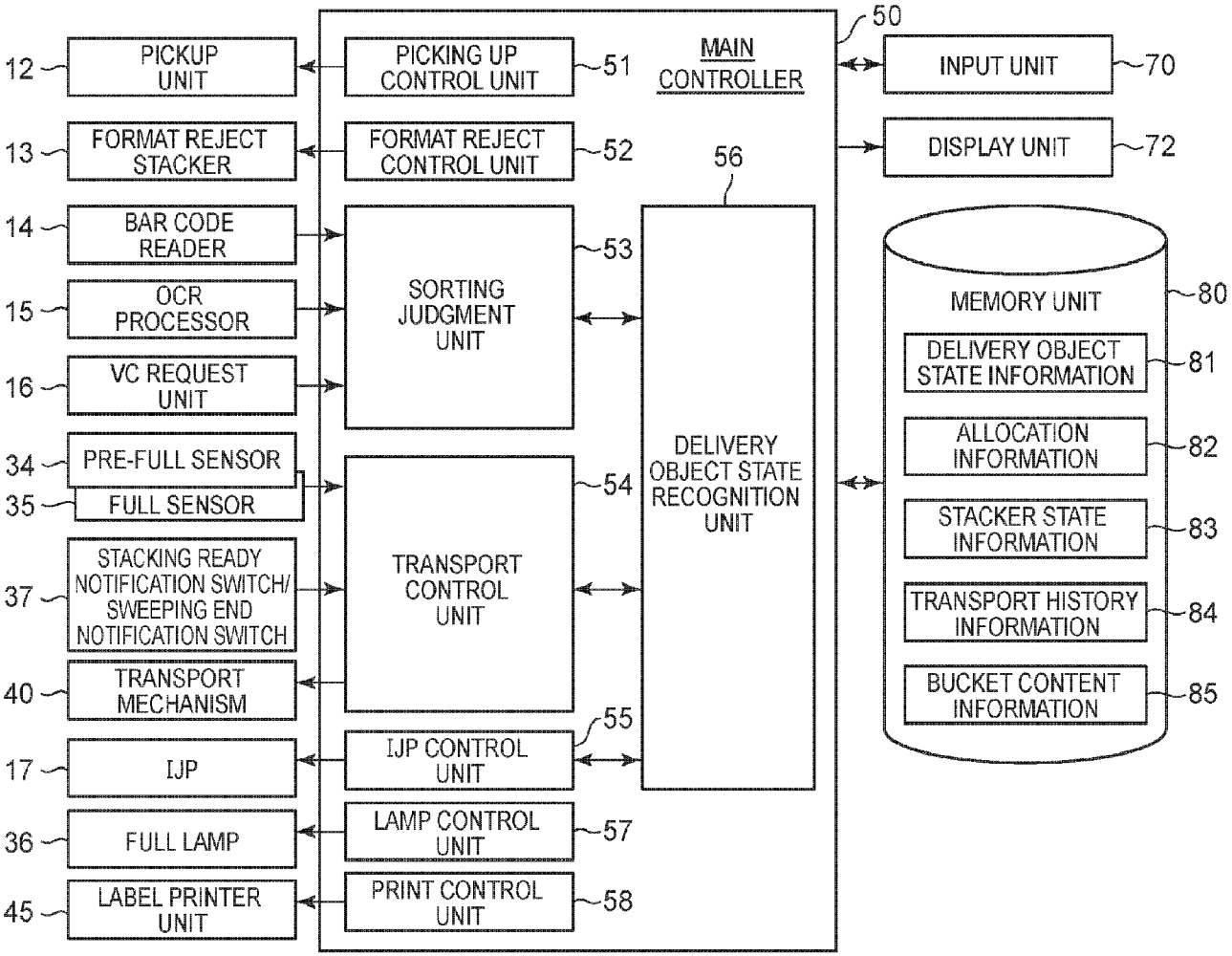
FIG. 12 is a diagram showing a configuration example of the delivery processing apparatus 1 centering on the main controller 50 of the second embodiment.

In the following, a second embodiment is explained. Here, the explanations focus on the differences to the first embodiment, and aspects that are the same as in the first embodiment are omitted. FIG. 12 is a diagram showing a configuration example of the delivery processing apparatus 1 centering on the main controller 50 of the second embodiment. In the second embodiment, the memory unit 80 stores transport history information 84. The transport history information 84 is information that chronologically lists, for each sort destination, the stackers 30 selected by the transport control unit 54 as the transport destination.

Figure 13:
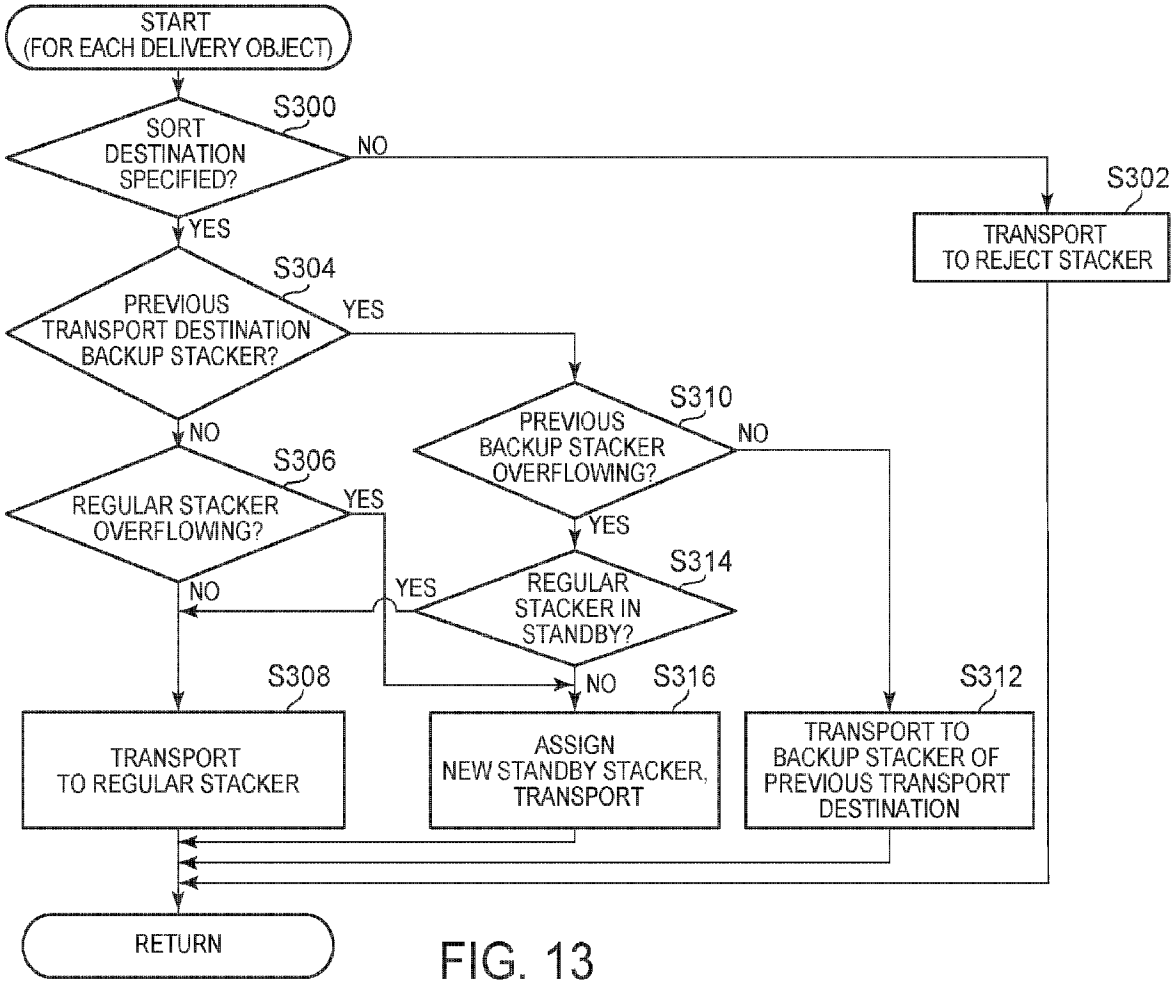
FIG. 13 is a flowchart showing the processing flow that is carried out by the transport control unit 54 according to the second embodiment.

FIG. 13 is a flowchart showing the processing flow that is carried out by the transport control unit 54 according to the second embodiment. First of all, the transport control unit 54 determines whether the stacker 30 serving as the sort destination is specified by the sorting judgment unit 53 (Step S300). If no stacker 30 is specified by the sorting judgment unit 53 as the sort destination, then the transport control unit 54 transports the delivery object S to the reject stacker (Step S302).

If a stacker 30 is specified by the sorting judgment unit 53 as the sort destination, then the transport control unit 54 looks up the transport history information 84 and determines whether the stacker 30 to which the delivery object S was transported as the previous transport destination is a backup stacker (Step S304). If the previous transport destination is not a backup stacker (but rather a regular stacker), then the transport control unit 54 determines whether this regular stacker is in the overflow state (Step S306). If the regular stacker is not in the overflow state, then the transport control unit 54 lets the transport mechanism 40 transport the delivery object S to the regular stacker (Step S308). On the other hand, if the regular stacker is in the overflow state, then the transport control unit 54 assigns a backup stacker as the new sort destination, and lets the transport mechanism 40 transport the delivery object S to the assigned backup stacker (Step S316).

If the previous transport destination is a backup stacker, then the transport control unit 54 determines whether the backup stacker of the previous transport destination is in the overflow state (Step S310). If the backup stacker of the previous transport destination is not in the overflow state, then the transport control unit 54 lets the transport mechanism 40 transport the delivery object S to the backup structure that served as the previous transport destination (Step S312).

If the backup stacker of the previous transport destination is in the overflow state, then the transport control unit 54 looks up the stacker state information 83 and determines whether the original regular stacker is in the standby state (Step S314). If the original regular stacker is in the standby state, then the transport control unit 54 lets the transport mechanism 40 transport the delivery object S to the original regular stacker (Step S308). On the other hand, if the original regular stacker is not in the standby state, then the transport control unit 54 assigns a new backup stacker as the sort destination and lets the transport mechanism 40 transport the delivery object S to this newly assigned backup stacker (Step S316).

With this delivery processing apparatus 1 according to the second embodiment as explained above, it is possible to achieve a similar effect as in the first embodiment through different software processing than in the first embodiment.

Further Considerations

In the foregoing embodiments, it was explained that a list L of characteristic information concerning the delivery objects S collected in the bucket B is printed, but it is also possible to output this list L of characteristic information concerning the delivery objects S as data to another device, instead of printing it out on paper or the like.

Furthermore, in the foregoing embodiments, it was explained that the transport control unit 54 detects that a stacker 30 is in the empty state when the corresponding stacking ready notification/sweeping and notification switch 37 is operated, but it is also possible that each stacker 30 is provided with a sensor that detects whether the respective stacker 30 is in the empty state, and based on the output of the sensor, the transport control unit 54 detects that the respective stacker 30 is in the empty state.

In accordance with at least one embodiment as explained above, if a regular stacker serving as a sort destination specified by the sorting judgment unit 53 goes into the overflow state, then the transport of delivery objects S to that regular stacker is stopped and, out of the plurality of stackers 30, a backup stacker that is not correlated with any address information is assigned as the sort destination substituting for the sort destination that has gone into the overflow state, and after assigning the backup stacker as the substitute sort destination, when the regular stacker that had gone into the overflow state goes into the empty state, the transport of delivery objects S to the backup stacker that was assigned as the substitute sort destination is stopped, and the transport of delivery objects S to the regular stacker that has gone into the empty state is resumed, so that the sorting and stacking of delivery objects S can be carried out more efficiently.

The above-described embodiments can be summarized as follows: a delivery processing apparatus that includes a plurality of stackers in which delivery objects can be stacked; a conveyer configured to transport the delivery objects to a designated stacker out of the plurality of stackers; a sensor for detecting the amount of stacked delivery objects in a monitored stacker out of the plurality of stackers; a switch that is operated by an operator when all delivery objects have been retrieved from the monitored stacker, out of the plurality of stackers; a specifying unit for looking up correlating information in which address information is correlated with a sort destination, using the address information obtained from a delivery object, and specifying a stacker serving as the sort destination of that delivery object; a transport controller unit configured to control the conveyer such that the delivery object is transported to that stacker serving as the sort destination, out of the plurality of stackers, that is specified by the specifying unit, wherein, if the stacker serving as the sort destination specified by the specifying unit is in the overflow state, then the transport controller unit stops the transport of delivery objects to the stacker serving as the sort destination that has gone into the overflow state and assigns, out of the plurality of stackers, a backup stacker that is not correlated with any address information, as a sort destination substituting for the sort destination that has gone into the overflow state, and after assigning the substitute sort destination, when a stacker that had gone into the overflow state goes into the empty state, the transport controller unit stops transport of delivery objects to the backup stacker that has been assigned as the substitute sort destination, and resumes the transport of delivery objects to the stacker that has gone into the empty state.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A delivery processing apparatus comprising:

a plurality of stackers configured to stack delivery objects;

a conveyer configured to transport the delivery objects to a designated stacker out of the plurality of stackers;

a full sensor configured to detect that a monitored stacker out of the plurality of stackers is in an overflow state in which more than a predetermined amount of delivery objects have accumulated and configured to output a full signal;

a pre-full sensor configured to output a pre-full signal;

a detector configured to detect that a monitored stacker out of the plurality of stackers is in an empty state in which all delivery objects have been retrieved from the stacker; and a main controller configured to specify a regular stacker that is a stacker out of the plurality of stackers and serving as a sort destination of the delivery object, based on address information that is obtained from the delivery object and, control the conveyer such that the delivery object is transported to the regular stacker serving as the sort destination, out of the plurality of regular stackers, that is specified, wherein, if the stacker serving as the sort destination specified is in the overflow state, then the main controller stops the transport of delivery objects to the regular stacker serving as the sort destination that has gone into the overflow state and assigns a backup stacker that is a stacker out of the plurality of stackers not correlated with any address information as a sort destination substituting for the sort destination that has gone into the overflow state, and after assigning the substitute sort destination, when a regular stacker that had gone into the overflow state goes into the empty state, the main controller continues transport of delivery objects to the backup stacker until the backup stacker goes into the overflow state, and when the backup stacker goes into the overflow state, the main controller then stops transport of delivery objects to the backup stacker that has been assigned as the substitute sort destination, and resumes the transport of delivery objects to the regular stacker that has gone into the empty state, wherein the detector is a switch to be operated by an operator who retrieves the delivery objects from the regular stacker when the regular stacker successively receives delivery objects, and wherein the main controller controls to reduce the number of backup stackers when the operating ratio of the backup stackers is low, to increase the number of backup stackers when the operating ratio of the backup stackers is high.

2. The delivery processing apparatus according to claim 1, wherein, when the backup stacker that has been assigned as the substitute sort destination has gone into the overflow state after the regular stacker that had gone into the overflow state has gone into the empty state, the main controller unit stops the transport of delivery objects to the backup stacker that has been assigned as the substitute sort destination, and resumes the transport of the delivery objects to the regular stacker in the empty state.

3. The delivery processing apparatus according to claim 1, wherein, if a backup stacker that has been assigned as a substitute sort destination has gone into the empty state, then the main controller unit cancels the assignment of the backup stacker as the substitute sort destination, and after that, if any regular stacker serving as the sort destination specified has gone into the overflow state, then that backup stacker is taken as a subject to assignment as a sort destination substituting the regular stacker that has gone into the overflow state.

4. The delivery processing apparatus according to claim 1, further comprising:

a list production unit for producing a list of characteristic information of each delivery object, based on a timing at which the regular stacker has gone into the empty state.

5. The delivery processing apparatus according to claim 4, wherein, for each storage container in which the delivery objects are collected that have been retrieved from the regular stacker, the list production unit produces a list of characteristic information of the delivery objects collected in that storage container.

6. A delivery processing method for a delivery processing apparatus comprising a plurality of regular stackers configured to stack delivery objects; a conveyer configured to transport the delivery objects to a designated regular stacker out of the plurality of regular stackers; a full sensor and a pre-full sensor configured to detect that a monitored regular stacker out of the plurality of stackers is in an overflow state in which more than a predetermined amount of delivery objects have accumulated, the full sensor configured to output a full, and the pre-full sensor configured to output a pre-full signal; a detector configured to detect that a monitored stacker out of the plurality of stackers is in an empty state in which all delivery objects have been retrieved from the stacker; and a specifying unit configured to specify a stacker serving as a sort destination of a delivery object, based on address information that is obtained from the delivery object; the method comprising:

controlling the conveyer such that a delivery object is transported to that regular stacker serving as the sort destination, out of the plurality of stackers, that is specified by the specifying unit;

if the regular stacker serving as the sort destination specified by the specifying unit is in the overflow state, stopping the transport of delivery objects to the regular stacker serving as the sort destination that has gone into the overflow state and assigning, out of the plurality of stackers, a backup stacker that is not correlated with any address information, as a sort destination substituting for the sort destination that has gone into the overflow state; and after assigning the substitute sort destination, when a regular stacker that had gone into the overflow state goes into the empty state, continuing transport of delivery objects to the backup stacker until the backup stacker goes into the overflow state, and when the backup stacker goes into the overflow state, the main controller then stopping transport of delivery objects to the backup stacker that has been assigned as the substitute sort destination, and resuming the transport of delivery objects to the stacker that has gone into the empty state;

the delivery objects being retrieved by an operator from the regular stacker;

successively receiving delivery objects to the regular stacker after the delivery objects being retrieved from the regular stacker; and controlling to reduce the number of backup stackers when the operating ratio of the backup stackers is low, and to increase the number of backup stackers when the operating ratio of the backup stackers is high.

7. The method according to claim 6, further comprising:

when the backup stacker that has been assigned as the substitute sort destination has gone into the overflow state after the regular stacker that had gone into the overflow state has gone into the empty state, stopping the transport of delivery objects to the backup stacker that has been assigned as the substitute sort destination, and resuming the transport of the delivery object to the regular stacker in the empty state.

8. The method according to claim 6, further comprising:

if the backup stacker that has been assigned as the substitute sort destination has gone into the empty state, cancelling the assignment of the backup stacker as the substitute sort destination, and after that, if the regular stacker serving as the sort destination specified by the specifying unit has gone into the overflow state, taking that backup stacker as a subject to assignment as a sort destination substituting the regular stacker that has gone into the overflow state.

9. The method according to claim 6, further comprising:

producing a list of characteristic information of each delivery object, based on a timing at which the regular stacker has gone into the empty state.

10. The method according to claim 9, further comprising:

for each storage container in which the delivery objects are collected that have been retrieved from the regular stacker, producing a list of characteristic information of the delivery objects collected in that storage container.

* * * * *